United States Patent [19]

Philipenko

[11] Patent Number: 4,685,339

[45] Date of Patent: Aug. 11, 1987

[54] SOIL SAMPLE TAKER AND VEHICLE MOUNTING ARRANGEMENT

[76] Inventor: Harry M. Philipenko, P.O. Box 294, Max, N. Dak. 58759

[21] Appl. No.: 625,626

[22] Filed: Jun. 28, 1984

[51] Int. Cl.[4] ..... G01N 1/08; E21B 49/02

[52] U.S. Cl. ..... 73/864.45; 175/20; 175/203; 175/308; 175/404

[58] Field of Search ..... 73/864.45, 864.44, 864.43, 73/864.42; 175/20, 162, 203, 58, 244, 249, 251, 254, 308, 403, 404

[56] References Cited

U.S. PATENT DOCUMENTS

| | | | |
|---|---|---|---|
| 1,088,903 | 3/1914 | Hyman | 175/308 X |
| 2,643,856 | 6/1953 | Hardman | 73/864.45 X |
| 2,709,368 | 5/1955 | Wolpert | 73/864.45 X |
| 3,057,415 | 10/1962 | Cox | 175/249 X |
| 3,464,504 | 9/1969 | Starge | 73/864.45 X |
| 3,515,230 | 6/1970 | Tomaine | 175/20 X |
| 4,284,150 | 8/1981 | Davis | 175/20 X |
| 4,333,541 | 6/1982 | Doty | 175/20 X |
| 4,534,231 | 8/1985 | Jonnson et al. | 73/864,43 |

FOREIGN PATENT DOCUMENTS

| | | | |
|---|---|---|---|
| 1484648 | 6/1967 | France | 73/864.45 |
| 152848 | 4/1963 | U.S.S.R. | 175/20 |
| 591743 | 2/1978 | U.S.S.R. | 73/864.44 |
| 1020564 | 5/1983 | U.S.S.R. | 175/403 |

*Primary Examiner*—Jerry W. Myracle
*Assistant Examiner*—Tom Noland
*Attorney, Agent, or Firm*—Brisebois & Kruger

[57] ABSTRACT

A soil sampler to be mounted on a vehicle such as a pick-up truck, has a frame for mounting on the vehicle and a vertical hydraulic cylinder connected at its upper end to the frame. A sample taking probe is connected to the rod of the cylinder which drives the probe vertically into the earth. A sample collecting receptacle is mounted on the frame for downward guiding movement with the probe to a position close to the earth. As the probe is retracted, the sample in the probe is extracted through an open side of the probe into the lowered receptacle. The receptacle is lifted during final retraction of the probe so that both the probe and receptacle are spaced sufficiently above the ground to move the vehicle to another sample taking location.

13 Claims, 11 Drawing Figures

FIG. 8.
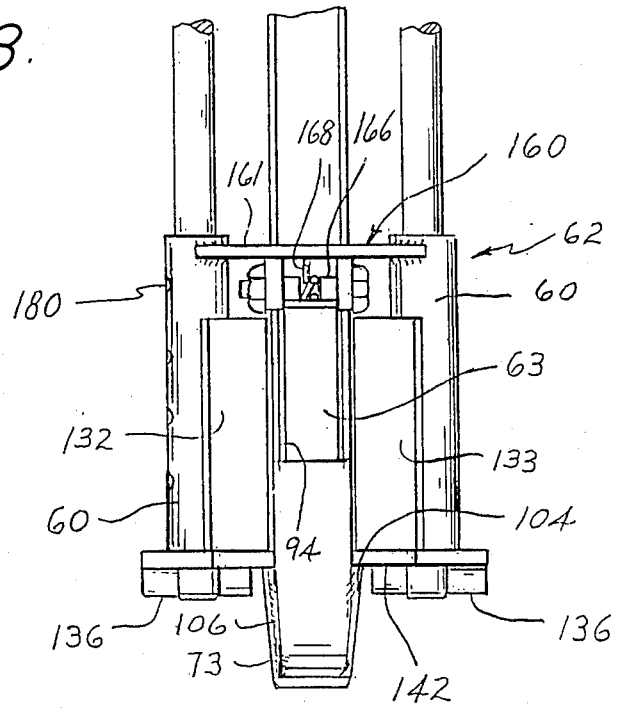
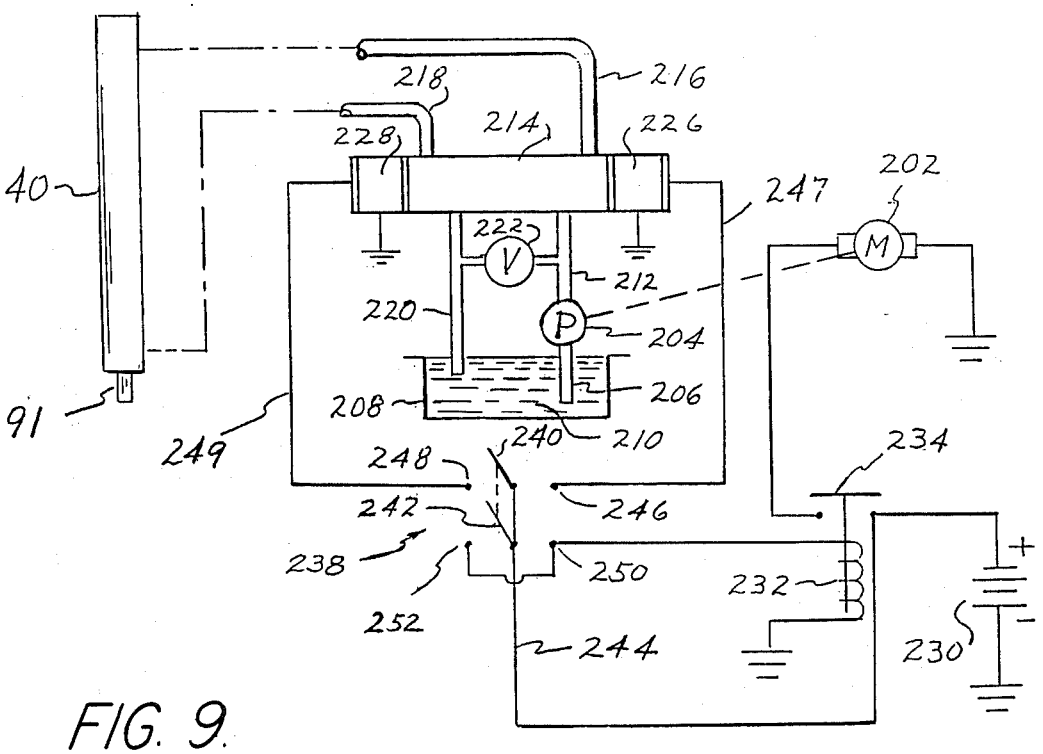
FIG. 9.

SOIL SAMPLE TAKER AND VEHICLE MOUNTING ARRANGEMENT

FIELD OF THE INVENTION

This invention relates to a soil sample taking apparatus which automatically ejects the taken sample, and which is mountable on a vehicle such as a pickup truck with minimal, if any, modification to the vehicle, and permits the vehicle to be used for its usual purposes, while the apparatus is mounted on the vehicle.

The invention also relates to a unique soil sample taking apparatus which can be mounted on a pickup truck without modifying the truck, and can be rapidly removed and remounted.

BACKGROUND OF THE INVENTION

Soil samplers of various types are known in the prior art. Such samplers can be of the auger type which rotate as the sampler is pushed into the earth, or can be of the force or penetrating type in which a hollow cylinder or probe is pushed vertically into the earth, without rotation. Depending on soil conditions and the region of the country in which a sample is to be taken, each of these samplers has its advantages.

It has been found, however, that the force type of sampler which includes a hollow probe which is forced into the earth is capable of taking more accurate representative samples of the soil of various different consistencies, and can also take samples from a much greater depth than the auger type samplers. In addition, the sample taken by the probe sampler is much more accurate where analysis of samples at different depths is required.

While the soil sampler disclosed in U.S. Pat. No. 4,316,393 has proven itself to be quite reliable, the samples taken by the tubular probe disclosed by that patent are frequently difficult to remove from the probe and require disconnecting the probe from the power cylinder in order to remove the sample. Another inconvenience of the arrangement of that patent is that a portion of the bed of the rear of the truck is obstructed by the sample taker so that the available loading space at the rear of the truck and the space available for carrying other cargo on the bed of the truck is somewhat limited.

Soil analysis is vital to present day commercial farming. Because of the high cost of fertilizer and other soil nutrients and chemicals, it is highly desirable to know the precise constituents of the soil so that the farmer can accurately fertilize and otherwise treat the soil to provide the required acidity or alkalinity for the crop to be planted.

In the past, many farmers have simply guessed at the amount of fertilizer required and have routinely applied lime to sweeten the soil, frequently in amounts much greater than those actually required for the crop to be planted. In many instances, the farmer routinely applies the same amount as the year before assuming that the soil conditions remain relatively constant from year to year.

While some farmers regularly sample and obtain analysis of their soil, many do not because of the difficulty, in the past, of quickly obtaining representative soil samples of sufficient depths to be of value. Even those farmers who normally regularly take soil samples, may often omit taking samples during a particular growing season because of unexpected conditions such as a late thaw or other work which they regard to be more important than soil sample taking because of the time required in the past to obtain representative samples.

While numerous attempts have been made in the past to provide reliable sample takers which can quickly take soil samples, the known prior devices have been slow and difficult to operate, require modification to a vehicle for mounting, and are either expensive or unreliable and subject to frequent breakdown. Another defect of such prior devices is that they are incapable of obtaining reliable samples of widely varying soil consistencies, particularly in relatively moist soil. For example, an auger cannot take an accurate sample of wet clay because the clay sticks to the auger, and clay is quite difficult to remove from a tubular sample probe.

In accordance with Applicant's invention, the shortcomings of the prior art are effectively overcome in an inexpensive and reliable manner.

SUMMARY OF THE INVENTION

In accordance with this invention, a soil sampler is provided which can easily be used by persons such as farmers, who have never previously taken soil samples, but who require representative samples of soil or earth from a relatively large area, such as a field in which crops are to be grown.

In accordance with the invention, the soil sample taker is mounted on a pickup truck using a simple mounting arrangement which is just behind the cab of the truck so that the bed or cargo area of the truck remains essentially unobstructed to permit carrying almost full cargo even when the sample taker is mounted on the truck. Advantageously, the sample taker is mounted at one side of the truck, just behind the driver's door, which provides the additional advantage that the sample taker can be operated by the driver while seated in the truck, the truck of course being stopped while the sample is taken.

In accordance with the invention, the probe is driven into and withdrawn from the soil by the action of a hydraulic cylinder. The cylinder is operated by hydraulic fluid pressurized by a hydraulic pump driven by an electric motor powered by the vehicle battery. This motor-pump unit can be placed at the front of the cargo area of the truck thereby minimizing the amount of cargo area which is obstructed by this unit, but is preferably supported on a cross-brace of the sample taker mounting frame so the entire floor of the cargo area is unobstructed.

In accordance with Applicant's invention, the probe has one side open and a curved finger extends into the probe through the open side to automatically eject or strip the soil sample into a collection receptacle as the probe is withdrawn from the earth.

In accordance with one aspect of the invention, the lower end of the probe is guided by a guide which moves downwardly during the initial descent of the probe and engages the earth adjacent the point of entry of the probe into the soil. Advantageously, the sample extractor which removes the soil from the probe, as well as the collection receptacle, is connected to and moves downwardly with the guide so that the entire sample within the probe can be stripped or removed from the entire length of the probe as the probe is withdrawn from the ground. In accordance with a preferred embodiment, the collection receptacle forms part of the guide for the probe and as the probe leaves the earth, during its upward travel, it engages the guide and lifts the guide and the receptacle upwardly to an elevated position which provides sufficient ground clearance for road travel, and for the vehicle to be driven to another location for taking another sample.

Advantageously, the probe and cylinder form a somewhat "free-floating" assembly by virtue of a pivotal connection of the cylinder to its mounting frame, at the upper end of the cylinder and the guiding of the probe at its lower end by the movable guide assembly. This arrangement not only provides for automatic alignment of the guide assembly with respect to the probe, but also facilitates and simplifies removing the cylinder, probe, and guide assembly from the vehicle.

By virtue of this floating cylinder and guide arrangement, virtually no modifications of the vehicle are required to mount the soil sampler on the vehicle, which assures that the vehicle manufacturer's warranty will not be affected by mounting the sampler on, for example, a new pickup truck.

The raising and lowering of the probe is controlled with a reversing switch that can be held by the driver of the vehicle seated in the driver's seat. The reversing switch is of the type which has a center OFF position to which it automatically moves when released, the switch controls the solenoid actuated valves, and the pump motor is driven only when the switch is activated, so battery drain is minimized.

Another aspect of the invention is the structure of the sample taking probe itself. The probe has an elongated body of U-shaped cross-section which defines a space or channel to receive the sample cut by a cutting tip at the lower end of the probe, as the probe is driven into the earth. This U-shaped space within the probe has an open side through which the sample is removed as the probe is withdrawn. To assure the taking of an accurate sample, and to prevent earth from the region facing the open side of the soil from falling into the probe, while the probe is in the earth, a slight projection or nose is provided at the lower end of the probe to force the soil through which the probe is driven, laterally away from the open side of the probe. This, in essence, creates a compressed column or wall of soil in opposed relation to the open side of the probe so that the entry of soil into the probe through the open side is minimized, and an accurate representative sample is therefore obtained. If soil falls into the open side of the probe, from a region near the surface of the earth, the resulting sample is not truly indicative of the soil to the depth to which the sample is taken.

In summary, the sample taker of the invention is quite reliable in operation, automatically removes the entire sample from the probe without danger of any sample loss, obtains a true sample to the depth of insertion of the probe, can conveniently be operated from the driver's seat of the vehicle such as a pickup truck without even opening the driver's door, provides adequate clearance in the retracted position of the probe to permit driving the vehicle from one location to another for representative sample taking, leaves the cargo area of the truck substantially unobstructed, can easily be mounted on and requires little, if any, modification of the vehicle for mounting.

Numerous other features and advantages of the invention will become apparent from the accompanying drawings and the detailed description relating to a preferred embodiment given as a representative example without limiting effect.

BRIEF DESCRIPTION OF THE DRAWINGS

FIG. 8 is a right-side view of the lower end of the soil sampler looking along line VIII—VIII of FIG. 7, but with the receptacle removed for purposes of illustration;

FIG. 9 is a diagram schematically showing the hydraulic and electric control circuitries for operating the soil sampler of FIG. 1;

DETAILED DESCRIPTION

Figure 1:
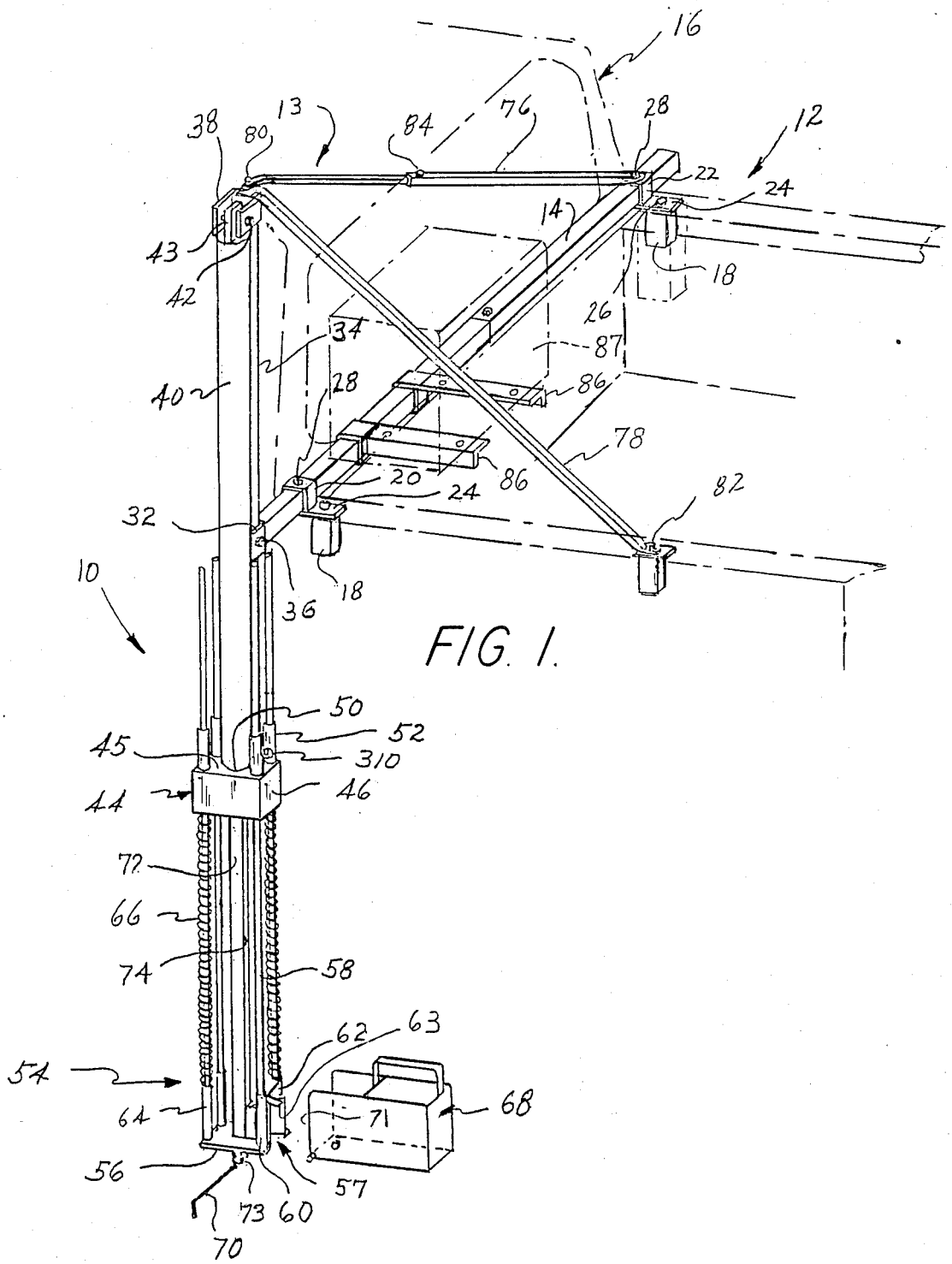
FIG. 1 is a pictorial view of a soil sampler according to the invention, mounted on a pickup truck partly shown in phantom lines.
Figure 2:
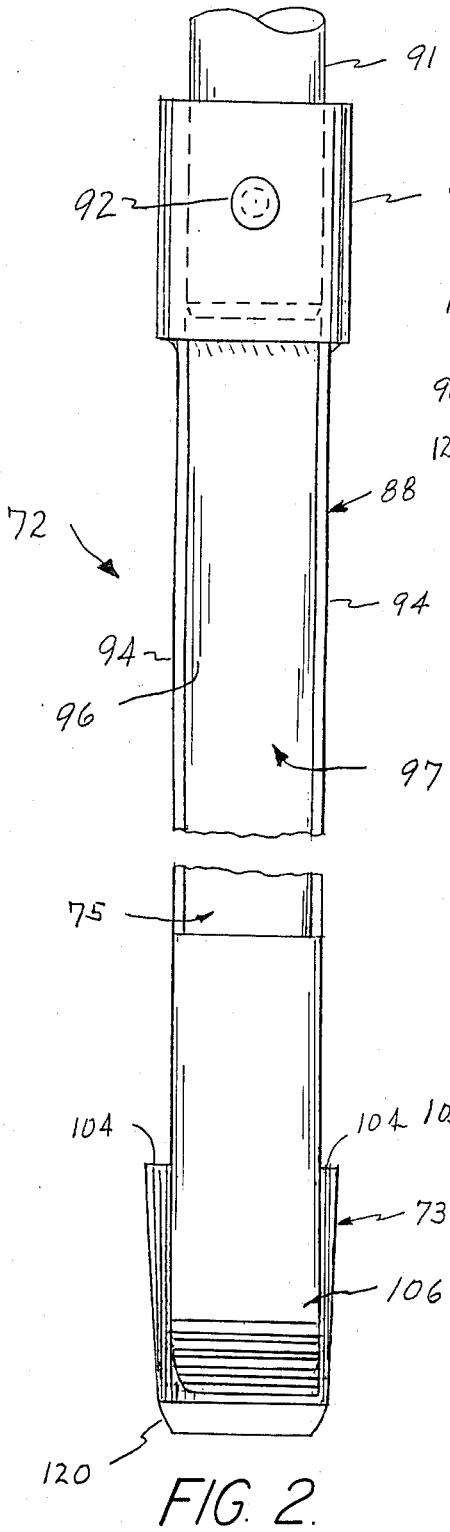
FIG. 2 is an enlarged right-side view of a sample taking probe which can be used with the soil sampler of FIG. 1.

Referring now to the drawings, particularly FIG. 1, there is shown a soil sample taker generally designated 10, according to the invention, mounted on a vehicle 12 (shown in phantom lines) which is preferably a pickup truck.

A mounting frame 13 includes a cross member 14 in the form of a square tube which extends across the truck at the front of the truck bed, just behind the cab 16 of the truck. Expandable stakes 18 like those shown and described in U.S. Pat. No. 4,316,393 are inserted in the usual forward stake openings in the sidewalls of the cargo area or bed of the truck. Cross member 14 extends through square sleeves of brackets 20 and 22, having lateral plates 24 which are fastened, respectively, to the stakes 18, with bolts 26 that extend through the stakes.

Threaded into the sleeves of brackets 20 and 22, are bolts 28 for clamping against the outside surface of cross member 14 to secure the brackets on the cross member. This arrangement permits adjusting the positions of the brackets to align them with the stakes and also provides for adjusting the cross member laterally to permit use of the same cross member on different makes of pickup truck.

Welded to one end of cross member 14 (at the driver's side of the vehicle) is a square sleeve 32 with its opening vertical. An upright support 34, in the form of a square tube extends through the sleeve 32 and is secured in the sleeve with a clamp bolt 36, which permits vertical adjustment of upright support 34, with respect to cross member 14.

Welded to the upper end of upright 34 are spaced apart mounting plates 38. A hydraulic cylinder 40 is pivotally connected to upright 34 with a bolt or pin 42, which extends through openings in plates 38 and a mounting bar 43 at the upper end of the cylinder. Cylinder 40 extends generally parallel to upright 34, and the lower end of cylinder 40 extends into a central opening of a box shaped guide unit 44 which is secured to the lower end of upright 34.

The guide unit 44 has a top plate 45 and a generally rectangular depending sidewall 46, with an open bottom. Welded to the rear of guide unit 44 is a square sleeve or socket (like socket 32) to receive the lower end of upright 34, and to which the upright is secured by a clamp bolt threaded into the socket.

The top plate 45 of guide unit 44 has a central opening 50 of a diameter slightly greater than the diameter of the lower end of cylinder 40 so that the lower end of the cylinder is a sliding fit in this opening. This permits the guide 44 to be assembled to the position of FIG. 1 by sliding the guide upwardly on upright 34 until the lower end of the cylinder is within opening 50, and then securing the guide to the upright with the clamp bolt.

Welded to top plate 45 of guide unit 44 are four vertical slide bearings in the form of sleeves 52 which are equally spaced from cylinder 40, and have their axes parallel to the axis of the central opening 50. Holes are bored in top plate 45 in alignment with the openings in the sleeves 52.

The lower end of the sampler includes a vertically movable guide assembly 54. Guide assembly 54 has a generally horizontal bottom plate 56 with a generally U-shaped opening 57 through one side of the plate. Secured to top plate 56 are four upwardly extending elongated guide rods 58 arranged to extend respectively through and slide in the four bearing sleeves 52 of guide unit 44. Mounting sleeves 60 of a sample extractor assembly 62 are mounted on the rods at the open side of the bottom plate 56, and spacer tubes 64 of the same length as sleeves 60 are mounted on the other two rods. The extractor assembly includes an extractor finger 63. An elongated compression spring 66 is mounted on each rod, although only two springs are shown at FIG. 1. The upper ends of springs 66 seat on the bottom of top plate 45 of guide unit 44, and the lower ends of the respective springs seat on upper ends of the sleeves 60 and spacer tubes 64. Each spring 66 is preferably of the same length so that the force of each spring to urge the guide assembly 54 downwardly toward the ground, is the same.

A sample collecting bucket or receptacle 68 is removably connected to bottom plate 56, by a pin 70. The receptacle has an open side 71 which faces toward the opening 57 of bottom plate 56.

A sample taking probe 72 is secured to the lower end of the piston rod of cylinder 40. The probe 72 is slidable in and extends through the opening 57 in the bottom plate and has a cone 73 at its lower end with a shoulder that engages the underside of the plate to support the movable guide assembly 54 when the probe 72 is in its retracted position as shown at FIG. 1.

To take a sample, probe 72 is forced downwardly into the earth to cut the sample and is then withdrawn to the retracted position of FIG. 1. As the probe is forced downwardly, guide assembly 54 and receptacle 72 move downwardly with probe 68, under the action of springs 66 until the guide assembly and receptacle are supported on the ground. The probe then continues downwardly to cut the sample. As the probe is withdrawn, the sample is lifted by the probe and is ejected through the open side 74 of the probe into the receptacle 68 by extractor finger 63 of the extractor assembly 62. When the cone 73 of the probe again engages bottom plate 56, as the probe moves upwardly, the plate 56 and receptacle 72 are lifted above the ground, to provide sufficient vertical clearance to permit moving the vehicle to other locations for taking additional samples.

The upper end of frame 13 is stabilized by braces 76 and 78 which are secured to a stud 80 at the top of upright 34. Brace 76 is in a common plane with upright 34 and crossmember 14, and has its lower end secured to bracket 22 with the bolt 28. Brace 78 extends rearwardly along the driver's side of the truck and has its lower end secured to an expandable stake, by a bolt 82.

Advantageously, the braces 76 and 78 are each telescopically adjustable. As shown for brace 76, the telescoping sections can be secured together with a clamp bolt 84. It is to be appreciated that the braces 76 and 78 are generally parallel respectively with the front and driver's side of the truck bed, so that these braces do not obstruct the cargo area of the pickup truck when the soil sampler is mounted on the truck. In addition, brackets 86 are mounted on crossmember 14 for supporting a motor-pump unit 87, shown in phantom lines, just behind the cab of the truck and above the level of the floor of the truck bed, to avoid obstructing the floor of the cargo area of the truck.

The sampler must be mounted on the truck so the bottom plate 56 and receptacle 72 are outwardly of the perimeter of the truck. The extent of outward projection, however, is less than 6 inches and does not interfere with road use of the vehicle 12.

FIGS. 2–5 show the sample taking probe 72 in greater detail. As shown, probe 72 has an elongated body 88, cone 73 being welded to the lower end of body 88, and a mounting sleeve 90 welded to its upper end. Mounting sleeve 90 has an inside diameter essentially the same as the outside diameter of the lower end of piston rod 91 of cylinder 40, so the probe can be mounted on the piston rod by sliding sleeve 90 upwardly onto the piston rod. The probe is secured to the piston rod with a pin or bolt 92 which extends through openings in the sleeve and rod.

The body 88 is formed from heavy gauge sheet metal bent to U-shape so that the body has parallel sidewalls 94 and a rear wall 96. The open side 75 of the body is opposite rear wall 96. It is preferred that body 88 be square, i.e. the width of rear wall 96 is the same as the width of each sidewall 94, as measured along the outside of the body, so that the sidewalls and rear wall define a rectangular sample receiving channel 97 of a depth from rear wall 96 to open side 75 which is slightly greater than its width between sidewalls 94.

The cone 73 is machined separately from the body 99 and takes the form of a frustoconical sleeve which converges in a direction away from body 88 from its top face or upper end 98 to its lower end 99. The upper end 98 of the cone initially presents a flat annular surface on which the lower end of body 88 is seated, and is then welded to the cone.

Figure 4:
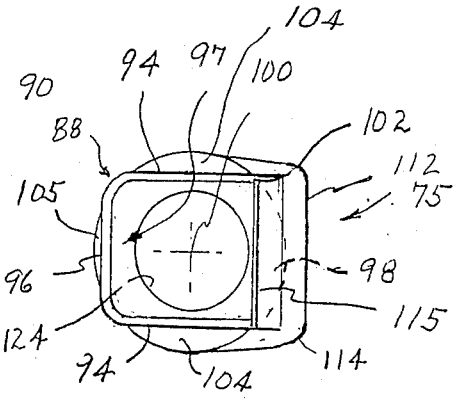
FIG. 4 is a view in section taken along line IV—IV of FIG. 3.
Figure 3:
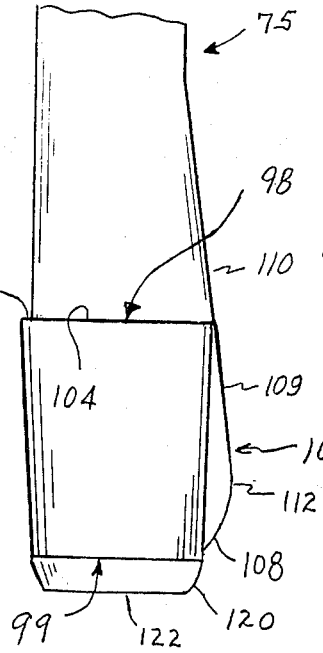
FIG. 3 is a front view of the probe of FIG. 2.

As shown at FIG. 4, the sidewalls 94 are each spaced the same distance from the axial center 100 of the cone. However, the inside surface of rear wall 96 is slightly further from the center 100 of the cone so that the end edges 102 of sidewalls 94 are just at the perimeter of the top face 98 of the cone. Stated differently, the rectangular space within the square body 88 which defines channel 97 is slightly greater to the left of center line 100 than it is to the right of the center line, as viewed at FIG. 4.

The lower end of body 88 is welded to the top surface 98 of cone 73 along the inside surfaces of sidewalls 94 and rear wall 96. This leaves flat, coplanar, upwardly-facing shoulders 104 of the top of the cone at opposite sides of the probe body 88. These shoulders 104 are segment-shaped, and extend outwardly beyond sidewalls 94. There may also be a small shoulder 105 beyond rear wall 96.

A soil compressing nose 106 which projects outwardly of the open side 75 of body 88 extends from just above the lower end 99 of the cone, to a location considerably above the cone. Nose 106 has a short lower portion 108 which curves outwardly from cone 73, and an intermediate portion 109 and an upper portion 110 which slant inwardly. The intermediate and lower portions merge at a smooth rounded outer portion 112 which is located below the vertical center of the cone and constitutes the maximum outward projection of nose 106.

As shown at FIG. 4, the outer portion 112 of nose 106 is of generally rectangular outline when viewed in plan, and the outside corners 114 are smoothly rounded. This outer portion 112 is wider than channel 97 in the probe. The upper portion 110 of this nose extends across and closes a length of the open side 75 of the body about equal to the height of cone 73. The upper portion 110 is in the form of a ramp of rectangular section along its length, whereas the intermediate portion 109 and the lower portion 108 blend smoothly into the outside surface of cone 73. As can be seen at FIG. 5, the intermediate portion 109 slopes at the same angle as the upper portion 110, and forms a continuation of the upper portion 110.

After the cone is welded to the lower end of body 88, rough edges and other imperfections resulting from welding are removed from the inside of the cone with a small grinder, to provide a smooth passage through the cone to channel 97, within body 88.

The soil compressing nose 106 is formed after body 88 is welded to the top of cone 73. A rectangular plate 115 (FIG. 5) of a width equal to the width of body 88 is placed at the front end of the top surface 98 of the cone so it slants toward and engages the front edges 102 of sidewalls 94. Plate 115, in this slanted position, is tack welded to the cone and to sidewalls 94, and is then welded along its sides to the front edges 102 of sidewalls 94, and along its bottom edge, to the adjacent side faces of the cone. In the region below the surface 98 (the plane of shoulders 104), the intermediate portion 109, outer portion 112, and lower portion 108, are formed by building up the front and adjacent sides of cone 73 with welding material. The portions 108, 109, and 112 are then ground and polished to blend the nose smoothly into the sides of the cone. Any welding material on shoulders 104 is filed or ground off so these shoulders are flat. The outsides of sidewalls 97 are also filed or ground to remove any weld material from the region above the shoulders 104.

Figure 5:
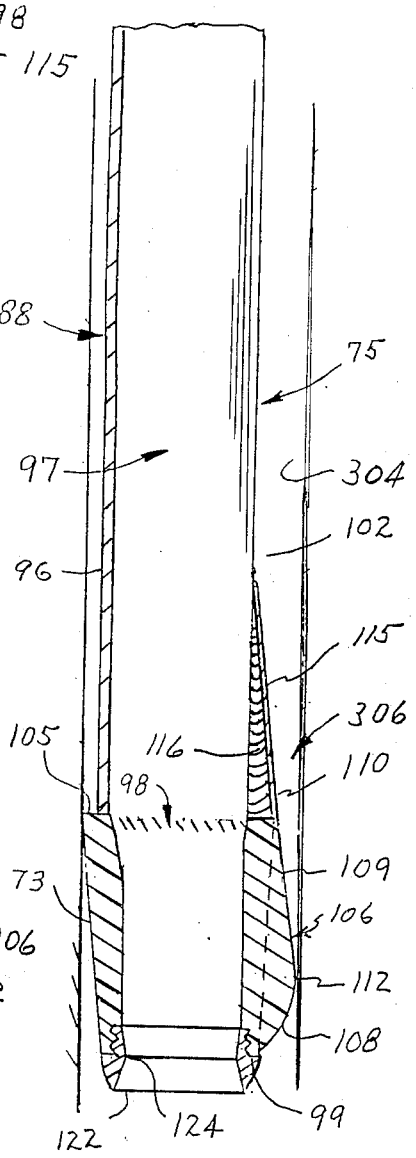
FIG. 5 is a view in axial section taken along line V—V of FIG. 4 and shows the compressed wall of soil formed by the probe nose.

As can be seen at FIG. 5, the sides of the narrow triangular space 116 within the upper portion 110 defined by the plate 115, are closed by welding.

The lower end of cone 73 has an internal thread 118 into which a sample cutting tip 120 is removably threaded. This sample cutting tip has a sharpened bottom edge 122, and an opening therethrough which first converges and then diverges to provide a constriction 124 in the cutting tip. The diameter of the cutting tip at constriction 124 is slightly less than the opening through cone 73, and is also smaller than either dimension of the rectangular channel 97 within the body 88 of the probe. This permits a soil sample cut by tip 120 to pass freely into the space within body 88 as the probe is forced into the soil.

In a preferred embodiment of the probe, the cone is $1\frac{1}{2}''$ long, the upper end 98 of cone 73 (before welding and polishing) has an outside diameter of $1\frac{1}{4}''$, and an inside diameter of $\frac{7}{8}''$, and the probe is 1" square. The plate 115 is $1\frac{1}{2}''$ high. A cutting tip 120 with a $\frac{3}{4}''$ diameter constriction 124 works very well under normal soil conditions. In wet soil or clay-like soil, a cutting tip with a $\frac{5}{8}''$ diameter constriction can be used.

Figure 6:
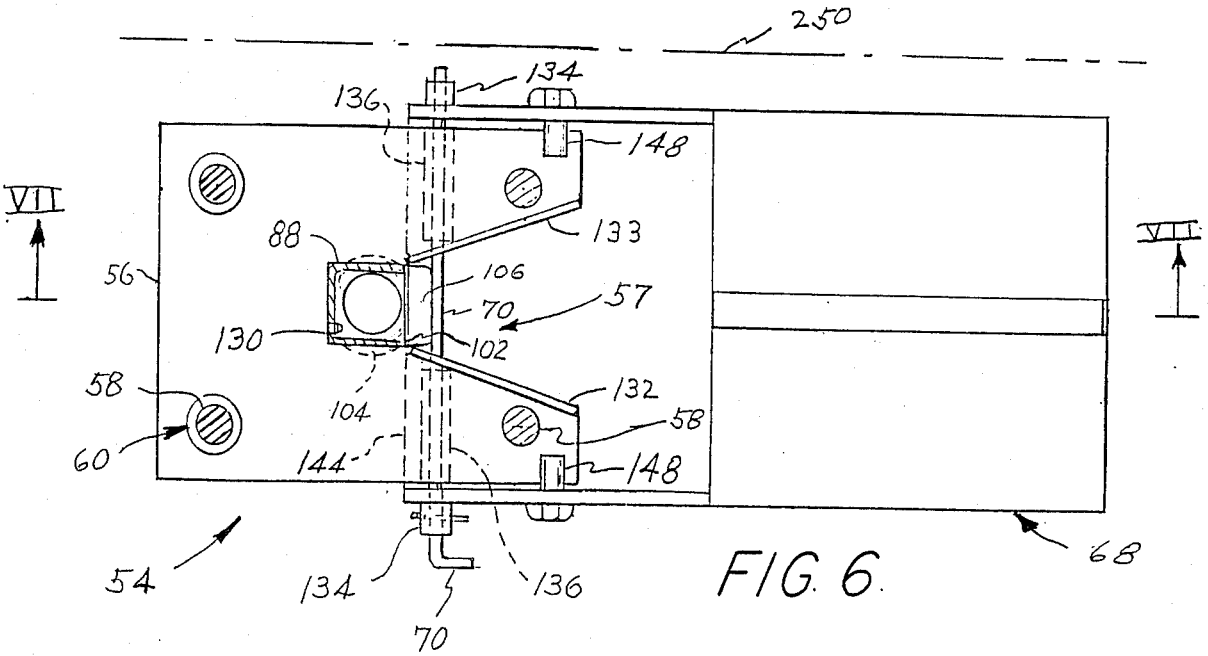
FIG. 6 is an enlarged plan view in section of the lower end of the soil sampler taken along line VI—VI of FIG. 7, with the extractor assembly removed to facilitate illustration.
Figure 7:
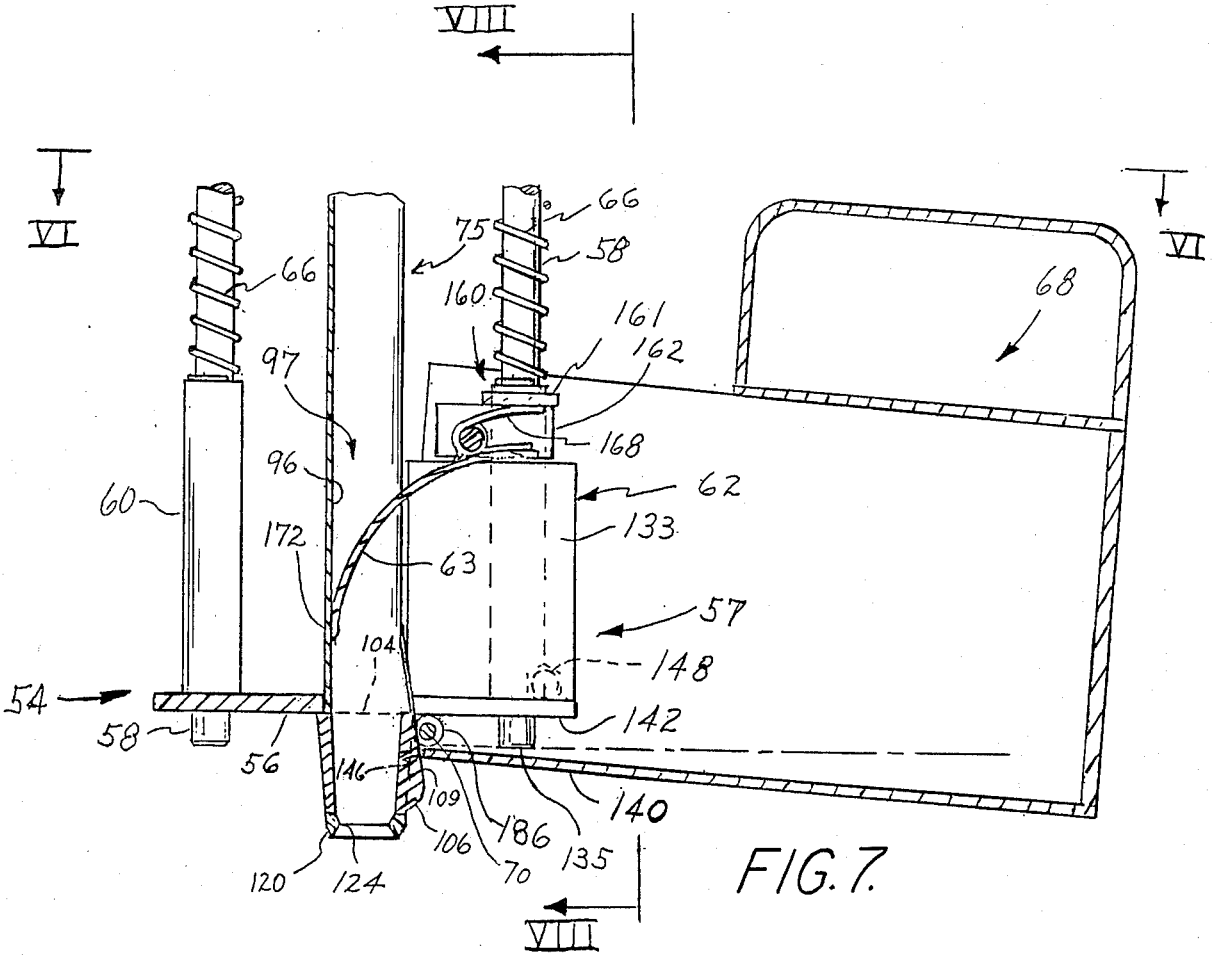
FIG. 7 is a partial front view in section taken along line VII—VII of FIG. 6, with the extractor assembly in place.

FIGS. 6 through 8 show the lower portion of guide assembly 54 in detail. The opening 57 has V-shaped sides which end at a slot 130 at the center of plate 56. Slot 130 is square and only slightly larger than body 88 of the probe so that the body 88 can slide vertically through this slot. Vertical soil sample guide plates 132 and 133 extend along the opposite sides of the V-shaped opening 57.

As shown at FIGS. 1 and 6, bushings 134 are provided at each side of the receptacle 68 at the front, lower corner of the open side of the receptacle. Openings through these bushings and the sidewalls of the receptacle provide for inserting the receptacle securing pin 70. Welded to the bottom surface of plate 56 are aligned sleeves 136 which extend to the sides but do not extend through the region of opening 57 of plate 56. The sleeves 136 receive pin 70 to attach receptacle 68 to bottom plate 56.

As shown at FIG. 7, when receptacle 68 is pinned to bottom plate 56, the bottom wall 140 of the receptacle is spaced slightly below the bottom surface 142 of plate 56, and the lower ends 135 of guide rods 58, which extend below plate 56 face toward bottom wall 140.

The front edge 144 of bottom wall 140 of the receptacle has a notch or slot 146. Threaded openings in the sidewalls of receptacle 68 permit insertion of studs or short bolts 148 which serve as abutments engaging the top surface of plate 56 to prevent receptacle 68 from pivoting clockwise from the position shown at FIG. 7, when the receptacle is attached to the bottom plate with pin 70. The studs are so located that the receptacle tilts slightly downwardly away from the bottom plate 56.

Bushings 134 on receptacle 68, and sleeves 136 on bottom plate 56 are so located that when the pin 70 is inserted to attach the receptacle, the front edge 144 of bottom wall 140 is essentially coplanar with the front edge 102 of probe body 88. The notch 146 in the bottom wall of the receptacle is of the same configuration as the nose 106 so there is only a slight clearance between notch 146 and the intermediate portion 109 of nose 106 when the probe is fully retracted as shown at FIG. 6. In this retracted position, the shoulders 104 engage the bottom surface 142 of the bottom plate. Sleeves 136 and pin 70 substantially close the gap between bottom wall 140 and plate 56 along the front of the receptacle.

The extractor assembly 62 includes a bracket 160 (FIGS. 7 and 8) which is secured to and extends between the upper ends of mounting sleeves 60. The bracket includes a top plate 161, and downwardly extending spaced apart support plates 162 which form a clevis for mounting the extractor finger 63.

As shown at FIGS. 7 and 8, extractor finger 63 takes the form of an arcuately curved blade which is pivotally connected to bracket 160. Attached to the back of extractor finger 63 are spaced apart mounting sleeves 166. A torsion spring 168 is positioned between these sleeves, and the extractor finger 63 is then pivotally connected to mounting plates 162 with a bolt or pin which extends through the mounting plates 162, the sleeves 166, and the opening through the center of the torsion spring. The torsion spring 168 functions to bias finger 63 clockwise, as viewed at FIG. 7, so that the lower rear surface 172 of the extractor finger is within channel 97 of the probe and pressed against rear wall 96 of the probe body 88.

As shown at FIG. 8, extractor finger 63 has a width which is only very slightly less than the distance between the side plates 94 of the probe body 88. As a result, the extractor finger 63 cleanly strips a sample through the open side 75 of the probe, as the probe containing the sample is pulled upward through plate 56.

It has been found that, depending on soil conditions, better extractor action can be obtained if the extractor finger 63 is adjusted up or down relative to receptacle 68. To provide for such adjustment, a series of holes 180 are formed in at least one sleeve 60, to receive a locking pin which is inserted into an opening drilled in rod 58. An opening through rod 58 which aligns with the uppermost opening 180 in sleeve 60 provides for locking the extractor assembly in its lower-most position as shown at FIG. 8, and also provides for adjusting the extractor assembly upwardly to different elevations with respect to bottom plate 56 and receptacle 68.

Cylinder 40 is powered with hydraulic fluid under pressure. This pressurized hydraulic fluid is provided by a motor-pump unit 87 which is adapted to be mounted on the brackets 86, and is shown in phantom lines at FIG. 1.

FIG. 9 shows the hydraulic and electrical circuit for controlling the motor pump unit and the cylinder 40.

As shown at FIG. 9, a motor 202 is mechanically connected to a pump 204 to drive the pump. Pump 204 has an inlet 206 which extends into a reservoir 208 filled with hydraulic fluid 210. The discharge line 212 of pump 204 is connected to a solenoid-operated four-way valve 214. Valve 214 has a hose or line 216 connected to the head end of cylinder 40, and a hose or line 218 connected to the rod end of the cylinder. A return pipe 220 is connected to four-way valve 214 to return hydraulic fluid to reservoir 208. A pressure relief valve 222 can be connected between pump discharge line 212 and the return or vent line 220.

Four-way valve 214 is of the well-known type which is spring urged to a central or neutral position in which all flow the the valve is blocked, is movable to a first position in which line 212 communicates with hose 216 to force piston rod 91 downwardly; while connecting line 218 to line 220 to vent fluid from the rod end of the cylinder, back to reservoir 208. The valve is also selectively movable to a second position in which line 212 communicates with hose 218, and hose 216 communicates with return line 220 so that the rod end of the cylinder is pressurized and the head end is vented, to retract piston rod 91. To move the valve 214 to the first or second position, the valve is conventionally provided with first and second solenoid actuators 226 and 228. The electricity to energize the solenoid actuators and motor 202 is obtained from the battery 230 of the vehicle on which the soil sampler is mounted. The circuit arrangement for energizing motor 202 includes a relay 232 which closes a contactor 234 to energize the motor when the winding of relay 232 is energized.

A double pole, double throw switch 238 controls valve 214 and motor 202 to advance and retract piston rod 91. Switch 238 is of the type which is spring urged to a center off position. The switch has simultaneously movable contacts 240 and 242 which are both connected to the hot or underground terminal of the battery 230 by cable 244. Fixed contacts 246 and 248 are connected respectively to the solenoid actuators 226 and 228 by wires 247 and 249. Fixed contacts 250 and 252 are connected to one end of the winding of motor energizing relay 232, the other end of the winding being grounded.

The movable contacts 240 and 242 are ganged together to move simultaneously. To advance or extend piston rod 91 contacts 240 and 242 are moved to the right to engage the fixed contacts 246 and 250 respectively, at the same time. When contact 240 engages contact 246, solenoid 226 is actuated to communicate line 212 with hose 216 to provide fluid to the head of cylinder 40, and to communicate return line 220 with hose 218 to vent hydraulic fluid from the rod end of cylinder 40. At the same time that solenoid 226 is energized, contact 242 engages contact 250 and relay 232 is energized and its winding closes contactor 234 to energize motor 202. Hydraulic fluid is thus pumped to the head of the cylinder 40 to extend piston rod 91. The extension of piston rod 91 can be stopped at any position simply by releasing the movable contacts 240 and 242, it being understood that these contacts are moved by a common actuator such as a push-button. As soon as the switch is released, solenoid actuator 226 is de-energized and the valve 214 assumes a neutral position. In this neutral position, flow into and out of lines 216 and 218 is blocked and correspondingly, the piston rod 91 is locked against movement. To retract piston rod 91 it is merely necessary to actuate the movable contacts 240 and 242 to engage the respective fixed contacts 248 and 252. This energizes solenoid actuator 228 and simultaneously energizes motor 202.

A distinct advantage of this arrangement is that motor 202 is energized only when valve 214 is also energized to direct the hydraulic fluid from pump 204 to hose 216 or 218. This arrangement vastly reduces the power required to drive pump 204 with motor 202, since a flow path is available to receive the hydraulic fluid, whenever the switch 238 is manually moved to either energized position. An additional distinct advantage of this arrangement is that high pressure fluid is not suddenly admitted to either the head end or the rod end of the cylinder. As a result, there is no shock or impact during the start of either extension or retraction of the piston rod. Instead, initial movement of the piston rod is slow, but the movement rapidly accelerates as motor 202 increases in speed and additional fluid is supplied by pump 204.

This arrangement also has the advantage of minimizing the pressure in the system in that only enough pressure builds up in the hoses 216 or 218 to extend and retract the piston rod, to in turn drive the probe into the ground and retract the probe to extract a soil sample.

Safety valve 222 prevents over pressure in the event the lower end of the probe engages a rock or other obstruction during downward movement, and also prevents over pressure in the event that switch 232 is held actuated at either end of the stroke of piston rod 91.

With this control arrangement, it has been found that soil samples can be taken an entire day, without danger of discharging the vehicle battery 230. It is to be recognized, of course, that the vehicle may be driven several hundred feet after each sample is taken, so the battery receives some charge from the vehicle alternator after each sample taking operation.

OPERATION

Referring to FIG. 1, sample taker 10 is mounted on the side of vehicle 12 with the axis of cylinder 40 and probe 72 essentially vertical, and with bottom plate 56 preferably spaced approximately 8 inches above the ground when the probe 72 is retracted. The sample taker is mounted so bottom plate 56 and receptacle 68 are outwardly of the side of the vehicle, spaced from, for example, a running board 250, shown in phantom lines at FIG. 6. While it would, of course, be possible to mount the sample taker with the bottom plate 56 higher above the ground, by simply loosening the lock bolt 36 and sliding upright 34 and thus the entire sample taker upwardly, too great a ground clearance is neither necessary nor desirable since the depth of the sample which can be taken decreases as the ground clearance is increased, for a cylinder 40 of a particular length of stroke.

FIG. 7 shows the lower end of the soil sampler in a "ready" position, in which the probe 72 is retracted, and the bottom plate 56 of the sampler is thus about 8 inches above the surface of the earth from which a sample is to be taken. As shown at FIG. 7, receptacle 68 is connected to bottom plate 56 by the pin 70, but the receptacle, because of its weight, tilts downwardly away from bottom plate 56 and is held at this inclination by engagement of studs 148 with the top surface of bottom plate 56. In the retracted position of FIG. 7, the entire lower guide assembly and receptacle are held against downward movement under the action of springs 66, by the lower end of the probe, by virtue of engagement of shoulders 104 of cone 73 with the underside of plate 56. With the receptacle so tilted downwardly about the axis of retaining pin 70, the notch 146 in the front edge of bottom wall 140 is just clear of nose 106 of the probe.

To take a sample, a switch 238 (FIG. 9) is actuated, as previously explanined, to cause cylinder 40 to move probe 72 downwardly.

Figure 10:
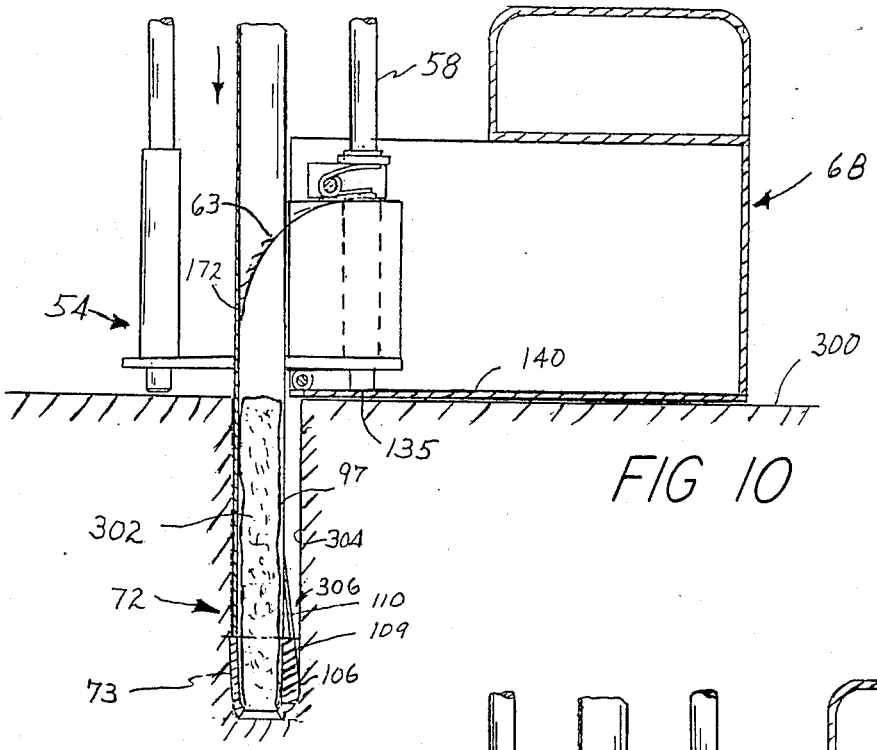
FIG. 10 is a view corresponding to FIG. 7 but showing the probe as it is forced into the earth to cut a soil sample.

As probe 72 moves downwardly, the entire guide assembly and receptacle move downwardly with the probe. Then, the bottom surface of receptacle 68 engages the surface 300 of the earth, which causes the receptacle to pivot counterclockwise until the top surface of bottom wall 140 engages the bottom ends 135 of the guide rods 58, as shown at FIG. 10. In this position, the bottom wall 140 of the receptacle is essentially horizontal, and supports the guide assembly on the ground against further downward movement, while probe 72 continues downwardly to cut a soil sample.

Such downward movement of the guide assembly 54 is assured by the springs 66. These springs are relatively weak and in essence assist gravity in forcing the lower end of guide assembly 54 downwardly to a position in which it is seated on the surface of the earth from which the soil sample is taken. It is to be appreciated that the springs 66 exert a sufficient force to prevent guide rods 58 from binding in sleeves 52 even when the sample receptacle 68 is fully loaded with taken samples.

As the probe proceeds downwardly, the cutting tip cuts a cylindrical sample 302 as the probe penetrates the earth, and this sample 302 is received in channel 97 in the probe.

As the probe penetrates the earth, the nose 106 at the side of the cone 73 compresses the soil to form a compressed wall 304 (FIGS. 5 and 10) spaced from the open side 75 of the probe. This compressed wall 304 of soil is resistant to crumbling so that soil from this wall does not fall into the open side of the probe, and assures that an accurate sample is taken. If some pieces of soil do fall downwardly from this wall, they tend to lodge in the space 306 between the ramp-like portions 109 and 110 of the nose and the wall 304, and are plastered back against the wall when the probe is retracted. During such downward movement of the probe relative to the guide assembly 54, the rear wall 94 of the probe slides along extractor finger 63. The constriction 124 in the cutting tip tends to compress the sample and also prevents the sample from falling through the bottom of the probe when the probe is withdrawn, so the cut sample is lifted as the probe is withdrawn.

Figure 11:
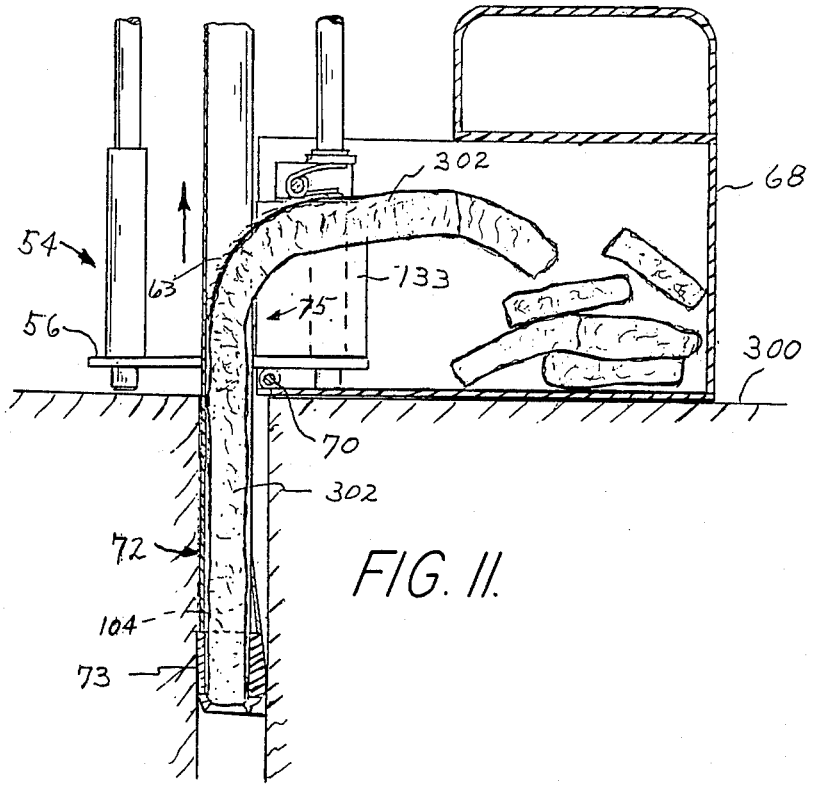
FIG. 11 is a view corresponding to FIG. 10 and showing the action of the extractor finger in extracting a sample from the probe as the probe is retracted.

When the probe is driven into the ground to the desired depth, for example, 24 inches, switch 238 is reversed to cause cylinder 240 to withdraw the probe. During withdrawal of the probe, (FIG. 11) the extractor finger 63 extracts or deflects the taken sample 302 into receptacle 68 through the open side 75 of the probe. During retraction of the probe, the bottom wall of receptacle 68 remains in contact with the surface 300 of the earth, and the open side of the probe between the surface 300 and bottom plate 56 is essentially closed by the front edge of the bottom wall of the receptacle, and the receptacle retaining pin 70. The guide plates 132 and 133 on bottom plate 56 form a funnel-like guide which assures that the sample is wholly extracted into receptacle 68 as the probe is retracted upwardly. Receptacle 68 remains in the position shown at FIG. 11, in contact with the surface 300 of the earth, until the probe is again retracted to a position in which the shoulders 104 of cone 73 again engage the underside of plate 56. The probe then lifts the entire guide assembly 54 and receptacle back to the position of FIG. 7 in which the bottom plate 56 is about 8 inches above the surface of the earth. The receptacle 68 again assumes an inclined position which tends to minimize the loss of a soil sample during travel to a new location for taking another sample.

In soft earth, the probe penetrates the earth to cut a soil sample at a rate of about 6 inches per second, and is withdrawn just as rapidly. Correspondingly, a soil sample to a depth of 2 feet can be taken in about 10 seconds, and then the vehicle can be moved to another location to take another sample. By virtue of the relatively rapid withdrawal of the probe, the sample 302 is thrown toward the rear of receptacle 68 by the extractor finger 63. When the receptacle 68 is filled with the soil samples, it is simply removed by withdrawing pin 70, removing the receptacle, and emptying the receptacle into a suitable bag or box. The receptacle is then reattached for further sample taking.

For road travel, receptacle 68 is removed, and guide assembly 54 is pushed upwardly by hand against the action of springs 66. The guide assembly can then be locked in a further raised position of, for example, 15 inches by tightening clamp bolt 310 (FIG. 1). The probe 72 can then easily be removed by removing pin 92 (FIG. 2) and pulling the probe downwardly off the lower end of piston rod 91. The probe can then be tilted and removed through the opening 57 in bottom plate 56.

For such removal, it may be necessary to lift the extractor assembly 62 to free the probe.

It is to be appreciated that the entire downward force of the probe is resisted by the pin 42 at the upper end of cylinder 40. As previously indicated, the lower end of cylinder 40 simply fits in the opening 50 of guide 44 with some play. This enables the cylinder and probe to automatically align with the guide assembly 54 during sample taking so that there is no binding between the probe and the guide assembly.

While preferred embodiments of numerous improvements in a soil sample taker have been shown and described, it is to be appreciated that numerous changes can be made without departing from the scope of this invention.

I claim:

1. A soil sampler comprising, in combination, a support frame adapted to be mounted on a vehicle, a sample-taking probe supported on said frame and comprising an elongated hollow element having one side open, and a soil cutter at a bottom end thereof, motor means mounted on said frame for driving said probe vertically downwardly into the ground and for retracting the probe upwardly from the ground to cut and withdraw a soil sample from the ground, a sample collecting receptacle, means for ejecting a soil sample through the open side of said probe into said receptacle during upward retracting movement of the probe, means mounting said receptacle for movement between a first position adjacent the level of the ground, in which the sample within the probe is ejected into the receptacle, and a second position in which the receptacle and the bottom end of the probe are spaced above the ground so that there is sufficient clearance to move the vehicle to another sample taking location.

2. A soil sampler according to claim 1 wherein said receptacle, in said first position, engages the ground.

3. A soil sampler according to claim 1 wherein said mounting means for said receptacle comprises means for guiding said probe during vertical movement thereof.

4. A soil sampler according to claim 1 wherein said mounting means further comprises means for moving said receptacle upwardly and downwardly between said first and second positions in response to upward and downward movement of said probe.

5. A soil sampler according to claim 1 further comprising means mounting said soil sample ejecting means for movement between an elevated position and a lowered position.

6. A soil sampler according to claim 1 wherein said mounting means comprises an elongate assembly extending around said probe, means on said support frame for guiding said assembly generally vertically, a lower end of said assembly comprising an opening through which said probe extends, an upwardly facing shoulder on said probe adjacent the lower end of the probe engaging a downwardly facing surface of the lower end of the assembly, and means for urging said assembly toward said shoulder so that the assembly is lifted and lowered in response to upward and downward movement of said probe.

7. A soil sampler according to claim 6 wherein said elongate assembly comprises a plurality of guide rods secured to a lower end of the assembly, said guide rods extending through guide bushings secured to said support frame, and spring means extending about said rods for urging said lower end of the assembly toward said shoulder of said probe.

8. A soil sampler according to claim 1 wherein said receptacle comprises a receptacle having an open side which faces toward said open side of the probe, said sample ejecting means comprises a curved finger extending into the open side of the probe for ejecting a sample through the open side of the probe into the receptacle through the open side of the receptacle, and a bottom edge of said receptacle comprises means closely adjacent the open side of the probe for confining the sample as the probe is withdrawn to prevent dislodgement of the sample below the receptacle.

9. A soil sampler according to claim 1 wherein said sample taking probe comprises an elongated probe body of U-shaped cross-section defining an elongated space along one side of the body, a hollow cone fixed to a lower end of said body, said cone converging toward its lower end, a soil cutting tip at the lower end of said cone, said soil cutting tip having an opening therein of a diameter less than the cross-sectional dimensions of the elongated space within the probe body, so that a sample cut by the tip is smaller than the space within the probe body and can be received in the space as the probe is forced into the earth, a projection on said probe below said space in the body and projecting laterally outwardly beyond the open side of said space for forcing soil, into which the probe is driven, laterally away from said open side to minimize entry of soil into the body through said open side, and wherein, said means for ejecting a soil sample through the open side of the probe comprises, a soil sample extracting finger extending into the probe body through said open side.

10. A soil sampler according to claim 9 wherein said projection of the sample taking probe comprises a slanted upper portion and a rounded lower portion.

11. A soil sampler according to claim 10 wherein said projection of the sample taking probe is of a width at least as great as the width of the open side of said space within the probe body, and wherein said projection comprises means for forming a compressed wall of earth opposite said open side of the probe as the probe is forced into the soil.

12. A soil sampler according to claim 11 wherein said sample taking probe further comprises an annular constriction within said cutting tip above a bottom cutting edge of the tip.

13. A soil sampler according to claim 12 wherein said cutting tip of the sample taking probe is removably threaded on said cone.

* * * * *